US011167394B2

(12) United States Patent
Roberts

(10) Patent No.: US 11,167,394 B2
(45) Date of Patent: Nov. 9, 2021

(54) PIPE ALIGNMENT CLAMP

(71) Applicant: Rick Roberts, Richfield, ME (US)

(72) Inventor: Rick Roberts, Richfield, ME (US)

( * ) Notice: Subject to any disclaimer, the term of this patent is extended or adjusted under 35 U.S.C. 154(b) by 93 days.

(21) Appl. No.: 16/740,641

(22) Filed: Jan. 13, 2020

(65) Prior Publication Data

US 2020/0254589 A1 Aug. 13, 2020

Related U.S. Application Data

(60) Provisional application No. 62/803,282, filed on Feb. 8, 2019.

(51) Int. Cl.

| | |
|---|---|
| ***B25B 5/00*** | (2006.01) |
| ***B25B 5/14*** | (2006.01) |
| ***B25B 5/10*** | (2006.01) |

(52) U.S. Cl.

CPC ..... *B25B 5/147* (2013.01); *B25B 5/10* (2013.01)

(58) Field of Classification Search

CPC ..... B25B 5/00; B25B 5/003; B25B 5/006; B25B 5/067; B25B 5/082; B25B 5/14; B23Q 3/00; B23Q 3/06

See application file for complete search history.

(56) References Cited

U.S. PATENT DOCUMENTS

| | | | | |
|---|---|---|---|---|
| 2,800,867 | A * | 7/1957 | Oliver | B23K 37/0533 269/189 |
| 5,911,799 | A * | 6/1999 | Johnson | B25G 1/10 81/177.4 |
| 6,332,381 | B1 * | 12/2001 | Vasudeva | B25B 15/008 81/177.1 |
| 10,907,756 | B2 * | 2/2021 | Anderson | B23K 37/0533 |
| 2006/0182513 | A1 * | 8/2006 | Dortch | F16B 23/0092 411/338 |

* cited by examiner

*Primary Examiner* — Lee D Wilson

(74) *Attorney, Agent, or Firm* — Brennan, Manna & Diamond, LLC

(57) ABSTRACT

A pipe alignment clamp for use in pipe fitting/fabrication applications. The pipe alignment clamp has a generally circular frame with at least one hinge therealong to enable the clamp to be opened and subsequently secured around a pair of pipe segments and/or fittings to be joined. Threaded support members are positioned along the frame in spaced apart fashion, and extend outwardly from each side of the frame. The support members are used to support alignment screws that can be independently repositioned radially towards and away from the pipe segments and/or fittings to be joined, thereby enabling the alignment clamp to accommodate a wide variety of different shapes and sizes of pipe segments and fittings, and requiring a minimum length of pipe segment to operate. The adjustment screws may be manipulated by hand, or by a separate alignment screw tool, which may be included as part of a pipe alignment kit.

7 Claims, 5 Drawing Sheets

PIPE ALIGNMENT CLAMP

CROSS-REFERENCE TO RELATED APPLICATION

The present application claims priority to and the benefit of U.S. Provisional Application No. 62/803,282 filed on Feb. 8, 2019, which is incorporated herein by reference in its entirety.

BACKGROUND

The present invention relates generally to a new and improved pipe alignment clamp for use in pipe fitting or pipe fabrication applications. More specifically, the invention relates to a relatively lightweight and compact profile pipe alignment clamp that can be used for aligning two pipe fittings, a section of a pipe and a pipe fitting, and/or two sections of pipe, and that requires significantly less pipe and/or pipe fitting length to function than existing pipe alignment clamps. Accordingly, the present specification makes specific reference thereto. However, it is to be appreciated that aspects of the present invention are also equally amenable to other like applications, devices and methods of manufacture.

When joining together two pipe fittings, a segment of pipe and a pipe fitting, or two segments of pipe or tubing, ensuring perfect alignment of the respective fittings or segments is crucial for successful fitting and/or fabrication of the pipe run or system. More specifically, if the two pipe segments and/or fittings are not properly aligned before they are joined via a manufacturing process, such as threading, brazing, cementing, welding or the like, the subsequent pipe run or system will not be properly connected and sealed and will not function as intended. Further, failure to properly align and seal the respective pipe segments and/or fittings may result in a leakage of the contents of the pipe system (e.g., fluids, gases, powders, etc.) at the junction of the two segments and/or fittings, which could, in turn, result in damage to the environment and necessitate costly and time consuming repairs that also impact production.

Currently, a variety of pipe alignment devices exist to aid a user in aligning two segments of pipe and/or pipe fittings so fabrication/fitting can occur. These existing alignment devices fall into several categories based on their inherent design which include: alignment stands; weld-on lugs; hydraulic bottle jacks; ratchet cable pullers; and clamps. While their exact composition, design, and means of operation may vary, all pipe alignment devices are intended to aid the user in aligning two segments of pipe and/or pipe fittings to be joined together, and each has its limitations.

For example, as explained more fully below, existing pipe alignment clamps generally share a common design and are typically comprised of a pair of articulating, generally "c" shaped frame members, a lower cross bar, an upper cross bar, and a threaded T-bar handle for operating the pipe alignment clamp. Each of shaped frame members are movably connected to each other by both the lower cross bar and the upper cross bar, and further comprise a slot formed therein. The presence of the pair of frame members and lower cross bar form an opening therebetween in which two segments of pipe to be joined together can be placed and properly aligned by the pipe alignment clamp. Additionally, a contact roller or pad may also be positioned on a distal end of each of the frame members and the lower cross bar for contacting and securing the pipe segments. Importantly, each of the contact rollers extend in a direction that is generally parallel to the lengths of pipe to be joined.

The T-bar handle is threaded through upper cross bar and is fixedly attached to lower cross bar such that when T-bar handle is rotated in a clockwise direction, lower cross bar moves downwardly in the direction of the segments of pipe, and frame members move inwardly towards the segments of pipe until each of contact rollers are in contact with each of the segments of pipe, thereby aligning and securing the same to be joined by a fabrication process, such as threading, brazing, cementing, welding, or the like.

Unfortunately, this type of pipe alignment clamp suffers from a number of limitations. For example, each of the pipe segments and/or pipe fittings to be joined must be sufficiently long enough for the contact members to be able to "grip" the same to perform the alignment and secure the segments or fittings while the same are joined, which may not always be the case. Similarly, if the pipe segments and/or fittings are of abnormal shape or size, or contain any number of curves, twists, etc., this type of alignment clamp cannot be used because the curved or twisted pipe segments and/or fittings would not have the minimum straight length that the clamp requires to rest on to operate on each segment.

Further, the contact pads of this type of clamp require that the two segments of pipe and/or fittings to be joined be substantially the same shape and size, which may not always be the case. Finally, the length and configuration of this type of clamp, with its elongated and protruding handle, may limit its applicability and usefulness if the pipe segments and/or fittings are being aligned and joined in a confined space.

Therefore, there exists a long felt need in the art for an improved pipe alignment clamp for pipe fitting/pipe fabricating applications that is relatively lightweight and compact in overall dimensions/profile, with no exceedingly long protruding members. Additionally, there is a long felt need in the art for an improved pipe alignment clamp that requires significantly less minimum pipe or pipe fitting length to operate, and that is capable of properly aligning pipe segments and/or pipe fittings having different shapes and/or sizes. Finally, there is a long felt need in the art for an improved pipe alignment clamp that is both safe and easy to use, and relatively inexpensive to manufacture.

In one exemplary embodiment, the generally circular pipe alignment clamp of the present invention comprises a generally semi-circular first frame member that is hingedly attached to a generally semi-circular second frame member, a fastener, a plurality of support members and a plurality of alignment screws for aligning and securing two segments of pipe and/or pipe fittings to be joined together during a manufacturing process, such as threading, brazing, cementing, welding, or the like. More specifically, each of the plurality of alignment screws are operational and adjustable independent of each of the remaining plurality of alignment screws, thereby allowing the alignment clamp to be used in conjunction with a wide variety of different shapes and sizes of pipe segments and fittings. Further, the relatively compact and lightweight design of the alignment clamp of the present invention enables the alignment clamp to be used in relatively confined spaces. Additionally, the particular radial and double-sided arrangement of the alignment screws relative to the frame members make it so that the alignment clamp requires substantially less pipe length per segment or fitting to be used compared to traditional devices.

In this manner, the improved pipe alignment clamp of the present invention accomplishes all of the forgoing objectives, thereby improving the ability of a user to successfully align two segments of pipe and/or pipe fittings using less pipe segment/fitting length than current alternatives that exist to complete the same task. The improved pipe alignment clamp also allows a user to align two pieces of curved or irregularly shaped or sized pipe. Finally, the improved pipe alignment clamp has a relatively compact profile and may be manufactured out of lightweight materials, thereby ensuring that it can be used in relatively confined spaces and will not be unwieldy to use.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one embodiment thereof, comprises an improved pipe alignment clamp. The pipe alignment clamp preferably comprises a doubly hinged, generally circular frame member that is comprised of two generally semi-circular frame members. The improved pipe alignment clamp further comprises one or more fasteners that function as both hinges and locks for the frame members, a plurality of support members and a plurality of alignment screws for aligning and securing two segments of pipe and/or pipe fittings to be joined together during a manufacturing process, such as threading, brazing, cementing, welding, or the like.

In an exemplary embodiment of the present invention, each of the plurality of support members are positioned in spaced apart relationship along each of the first and second frame members and extend outwardly therefrom in both an inboard and an outboard direction. As a point of reference, the inboard direction refers to the longitudinal direction of the first of the two pipe segments to be joined, and the outboard direction refers to the longitudinal direction of the second (or opposite) of the two pipe segments to be joined. Each of the plurality of support members further comprise a pair of threaded openings therein, with a first one of said threaded openings being positioned on the inboard side of the frame members and the second of said threaded openings be positioned on the outboard side of the frame members. The threaded openings are for receipt of the alignment screws and are orientated such that the alignment screws move in a direction that is directly towards, or away from, the surface of the pipes being joined. More specifically, each of the plurality of alignment screws are operational and adjustable independent of each of the remaining plurality of alignment screws, thereby allowing the improved alignment clamp to be used in conjunction with a wide variety of different shapes and sizes of pipe segments and fittings.

To operate the improved alignment clamp of the present invention, the user would unhinge one of the two frame hinges by removing the fastener, and place the alignment clamp around the junction of the two pipe segments or fittings to be joined such that the approximate centerline of the frame is directly over the junction and the alignment screws positioned on each side of the frame are capable of contacting each of the two pipe settings/fittings. The user would then rehinge the frame members by reinserting the fastener so that the alignment clamp completely encircles the junction of the pipe segments/fittings, and then thread each of the plurality of alignment screws until the same are in contact with the respective pipe segments/fittings. The two pipe segments/fittings can then be joined together via a manufacturing process, such as threading, brazing, cementing, welding, or the like, and the alignment clamp can be removed by again unhinging one of the two hinges.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION

Figure 1:
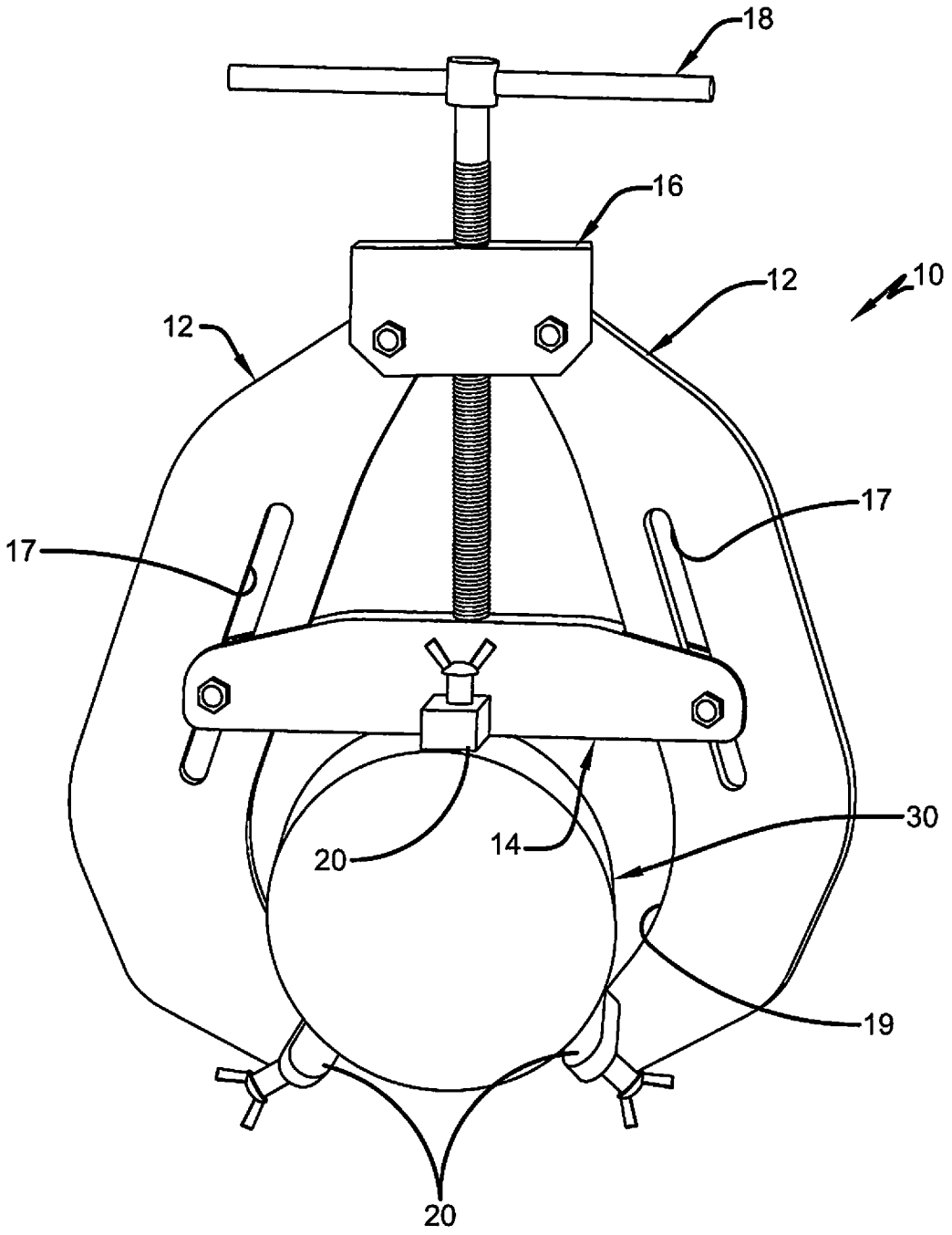
FIG. 1 PRIOR ART
FIG. 1 illustrates a perspective view of a prior art pipe alignment clamp in a closed position on a section of pipe.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

As noted above, there exists in the art a long felt need for an improved pipe alignment clamp to aid a user in aligning two segments of pipe and/or pipe fittings for joining via a manufacturing process, while not being limited in usage by such factors as the length of available pipe segment or fitting to which to attach to, or the respective shape or size of the pipe segments and/or fittings being joined. There also exists in the art a long felt need for an improved pipe alignment clamp that can be utilized in a relatively confined space, and that is both safe and easy to use and relatively inexpensive to manufacture.

The alignment clamp of the present invention is designed to allow a user to align two segments of pipe and/or pipe fittings to be joined in a manufacturing process, while requiring less pipe segment and/or fitting length than current alternatives. As explained more fully below, the independent nature of the alignment screws also permit a user to align two irregularly shaped or curved pipe sections/fittings, or two pipe sections/fittings having different sizes, while still maintaining a compact and lightweight overall profile.

Referring initially to the drawings, FIG. 1 illustrates a perspective view of a prior art pipe alignment clamp 10 in a closed position on a section of pipe 30. As explained above, clamp 10 is typically comprised of a pair of articulating, generally "c" or claw shaped frame members 12, a lower cross bar 14, an upper cross bar 16, and a threaded T-bar handle 18 for operating the pipe alignment clamp 10. More specifically, each of shaped frame members 12 are movably connected to each other by both the lower cross bar 14 and the upper cross bar 16, and further comprise a slot 17 formed therein to permit movement of lower cross member 14 relative to frame members 12 and upper cross member 16. The presence of the pair of frame members 12 and lower cross bar 14 form an opening 19 therebetween in which two segments of pipe 30 to be joined together can be placed and properly aligned by pipe alignment clamp 10. Additionally, a contact roller or pad 20 may be positioned on a distal end of each of the frame members 12 and lower cross bar 14, as best shown in FIG. 1. Importantly, each of contact rollers 20 extend in a direction that is generally parallel to the lengths of pipe 30 to be joined.

T-bar handle 18 is typically threaded through upper cross bar 16 and is fixedly attached to lower cross bar 14 such that when T-bar handle 18 is rotated in a clockwise direction, lower cross bar 14 moves downwardly in the direction of the segments of pipe 30, and frame members 12 move inwardly towards the segments of pipe 30 placed in opening 19 until each of contact rollers 20 are in contact with each of the segments of pipe 30, thereby aligning and securing the same to be joined by a fabrication process, such as threading, brazing, cementing, welding, or the like. Further, once the fabrication process is completed, T-bar handle 18 may be rotated in a counter-clockwise direction, thereby causing (a) lower cross bar 14 to move upwardly in the direction of upper cross bar 16 and away from the newly joined segments of pipe 30, and (b) frame members 12 to move outwardly away from one another and away from the newly joined segments of pipe 30.

Unfortunately, as stated supra, prior art pipe alignment clamp 10 suffers from a number of limitations. For example, each of the pipe segments and/or pipe fittings 30 to be joined must be sufficiently long enough for the contact members 20 to be able to "grip" the same to perform the alignment and secure the segments or fittings while the same are joined, which may not always be the case. For example, in some circumstances, a user may need to join one or two abnormally short pipe segments 30, whose overall lengths are not sufficiently long enough to allow contact members 20 to rest on one or both of said segments. Instead, a shortened pipe segment may result in the contact members 20 partially or fully overhanging off of one or both of the pipe segments, thereby rendering the clamp 10 usable. Similarly, if the pipe segments and/or fittings 30 are of abnormal shape or size, or contain any number of curves, twists, etc., alignment clamps such as clamp 10 also cannot be used. This is true, for example, because the curved or twisted pipe segments and/or fittings 30 would not have the minimum straight length that clamp 10 requires to rest on to operate on each segment.

Further, the contact pads 20 of clamp 10 require that the two segments of pipe and/or fittings 30 to be joined be substantially the same shape and size, which may not always be the case. For example, clamp 10 will not function to align a pipe segment and a pipe fitting, wherein the pipe fitting has a diameter that differs from that of the pipe segment. This is true because the contact members 20 that extend outwardly from each side of, for example, frame members 12, are not capable of moving independent of one another to engage their respective pipe segment/fitting 30.

Additionally, the length and configuration of clamp 10 may limit its applicability and usefulness if the pipe segments and/or fittings 30 are being aligned and joined in a confined space. For example, the shape, size and configuration of handle 18 which protrudes outwardly from the rest of prior art clamp 10 may limit a user's ability to use clamp 10 in a confined setting. The improved pipe alignment clamp of the present invention overcomes all of these limitations, and is both safe and easy to use.

Figure 2:
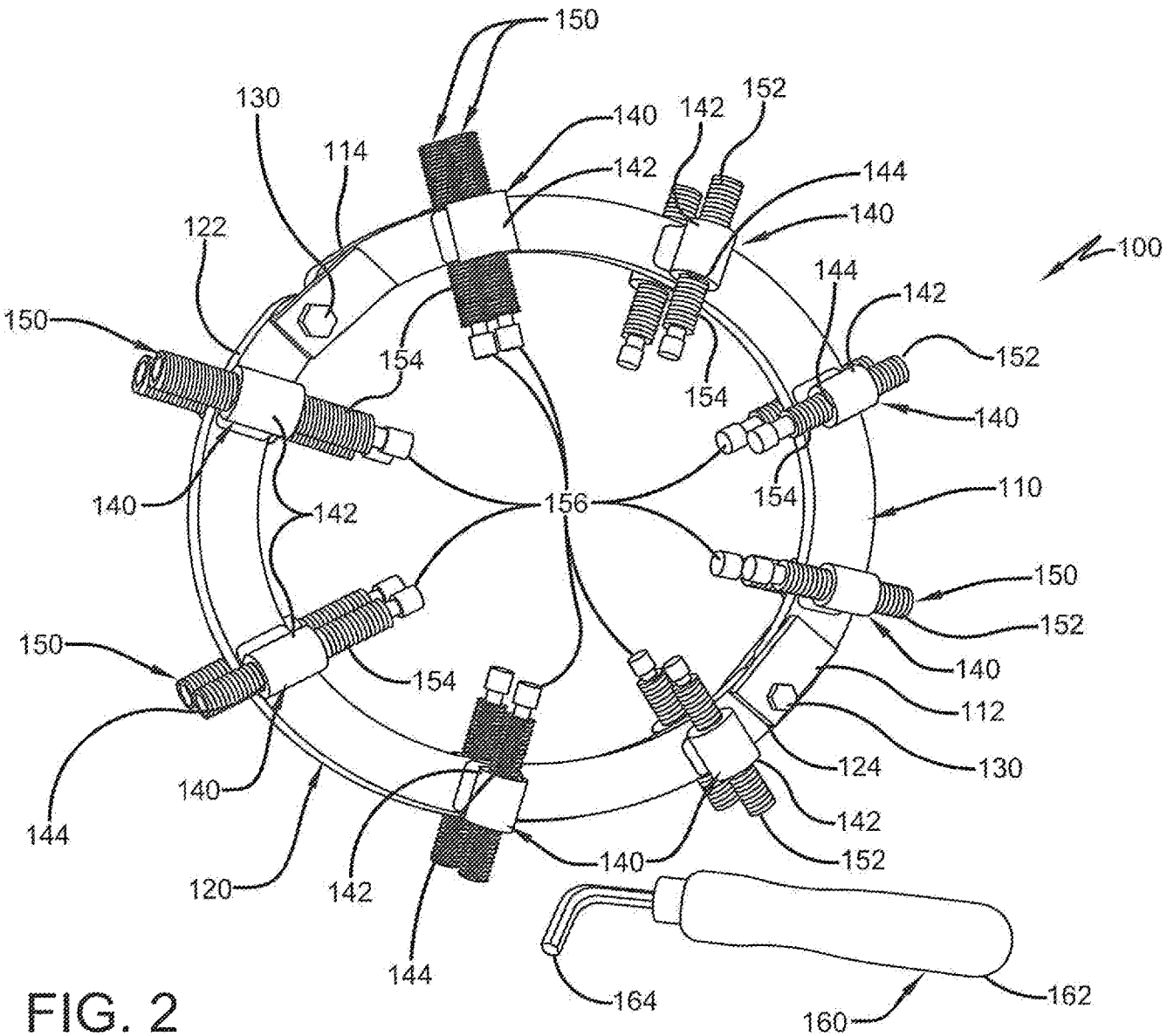
FIG. 2 illustrates a perspective view of one potential embodiment of the pipe alignment clamp of the present invention in a closed position and in accordance with the disclosed architecture, and an alignment tool that may be used in conjunction therewith.

More specifically, FIG. 2 illustrates a perspective view of one potential embodiment of the improved pipe alignment clamp 100 of the present invention, which is preferably comprised of a first frame member 110, a second opposing frame member 120, at least one fastener 130, a plurality of support members 140 and a plurality of alignment screws 150. As explained more fully below, it is also contemplated that improved pipe alignment clamp 100 may be provided as part of a kit that further comprises an alignment screw tool 160, as also shown in FIGS. 2-5.

Figure 5:
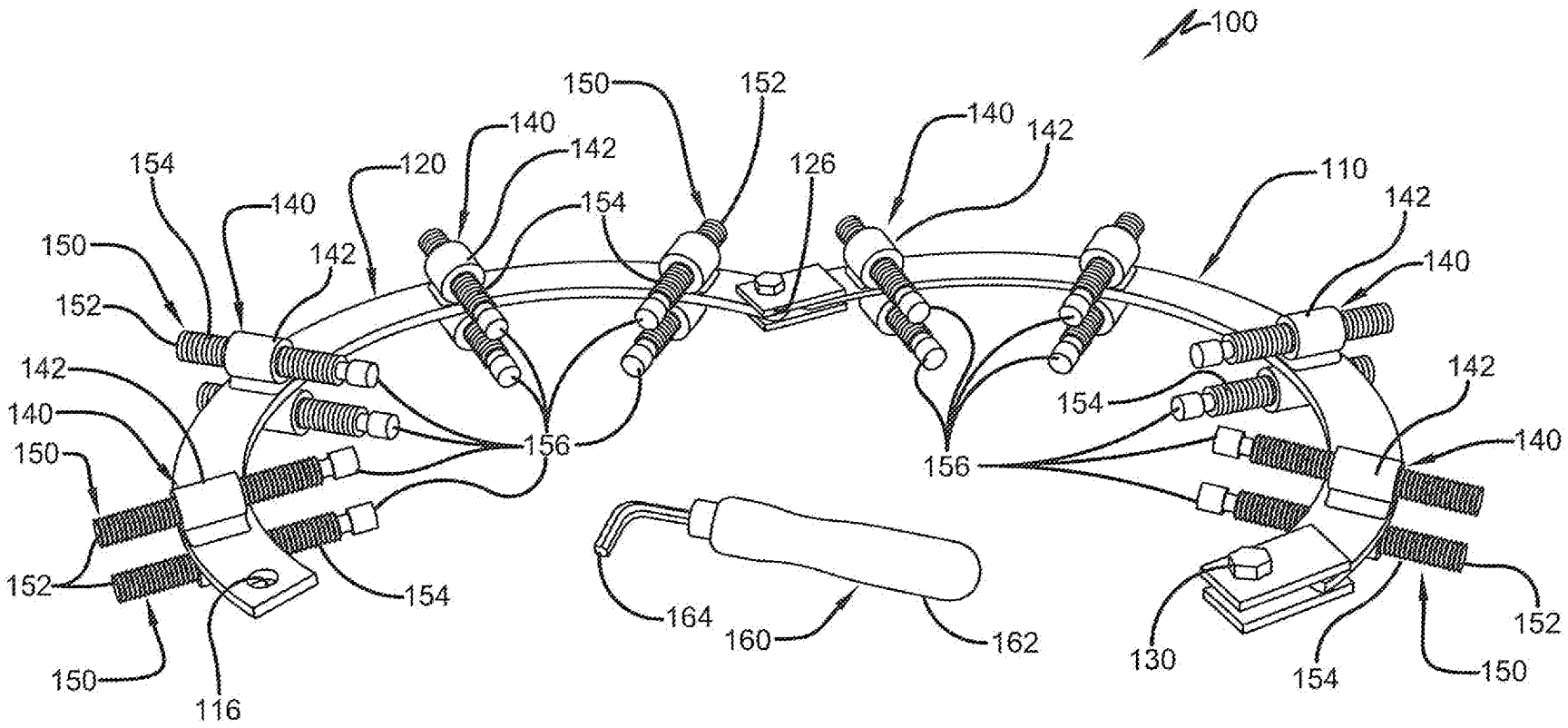
FIG. 5 illustrates a perspective view of the pipe alignment clamp of FIG. 2 in an open/unhinged position and in accordance with the disclosed architecture.

Each of first frame member 110 and second frame member 120 is a generally c-shaped or semi-circular member that, when combined with the opposing frame member, form a generally circular shaped pipe alignment clamp 100 that is useful for both securing and aligning two segments of pipe or pipe fittings 30, as explained more fully below. More specifically, each of first and second frame members 110, 120 is preferably comprised of a durable metal, such as steel or iron, though it is also contemplated that other materials may also be used such as hardened plastic and the like. Further, first frame member 110 is comprised of a first end 112 and a second end 114, and second frame member 120 is also comprised of a first end 122 and a second end 124. First ends 112, 122 and second ends 114, 124 are manufactured and configured to be removably attached to one another and each comprise an opening 116, 126 therein, respectively. For example, first ends 112, 122 may be in the form of a single generally flat male plate with an opening 116 therein (as best shown in FIG. 5) for mating engagement with a pair of generally flat and spaced apart female plates on second ends 114, 124 with a continuous opening 116 formed therein, as also shown in FIG. 5, or vice versa. It is also contemplated that first frame member 110 may have a single generally flat male plate with an opening 116 formed therein positioned on both its first and second ends 112, 114, and that second frame member 120 may have a pair of generally flat and spaced apart female plates on both its first and second ends 122, 124 with a continuous opening 126 formed therein for mating engagement with first frame member 110, or vice versa. In any event, when the male and female portions of first and second frame members 110, 120 are engaged, and openings 116, 126 aligned, fastener 130 may be inserted to openings 116, 126 to removable attach first frame member 110 to second frame member 120.

Figure 3:
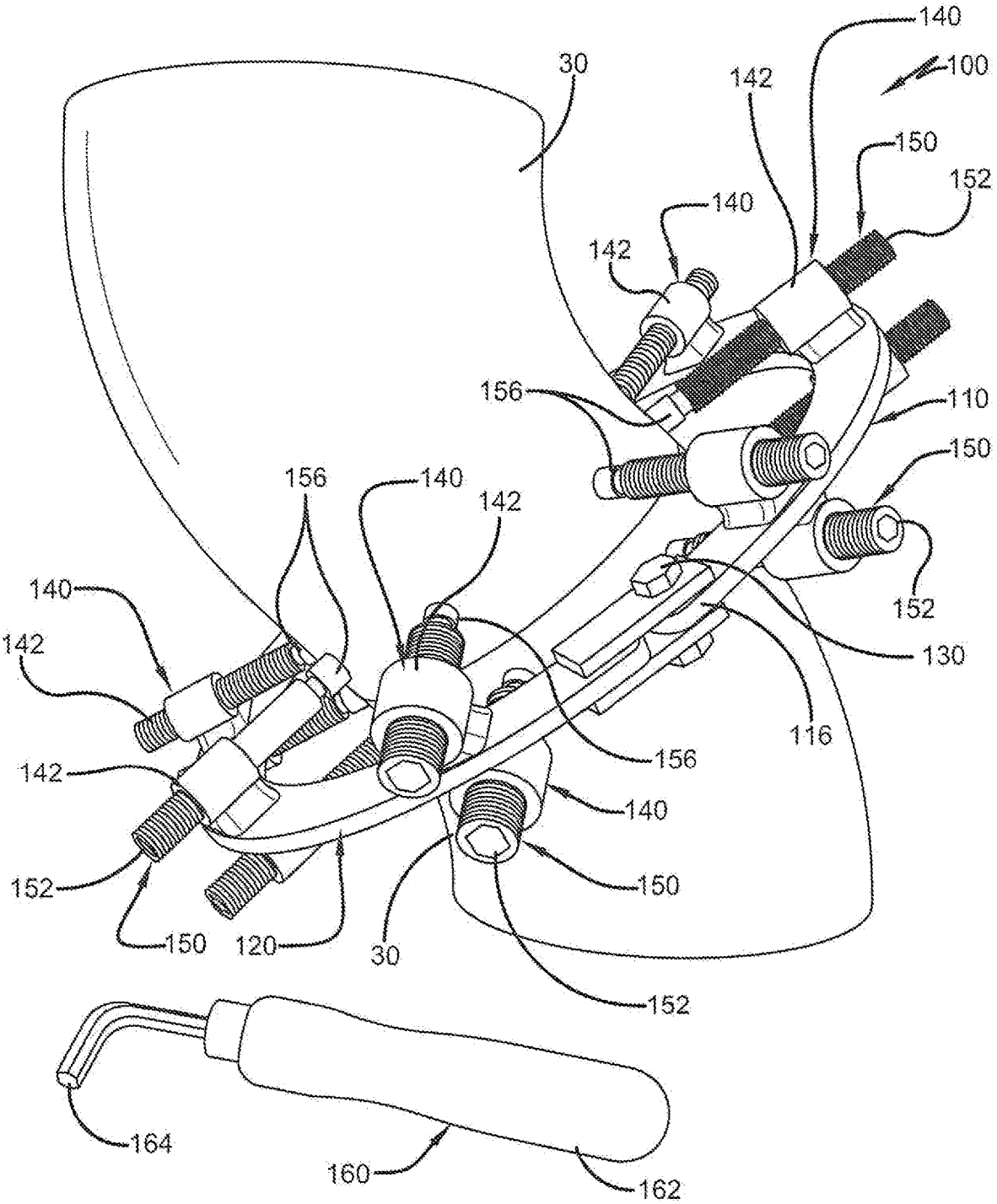
FIG. 3 illustrates a perspective view of the pipe alignment clamp of FIG. 2 closed around the junction of two irregularly shaped pipe segments and in accordance with the disclosed architecture.
Figure 4:
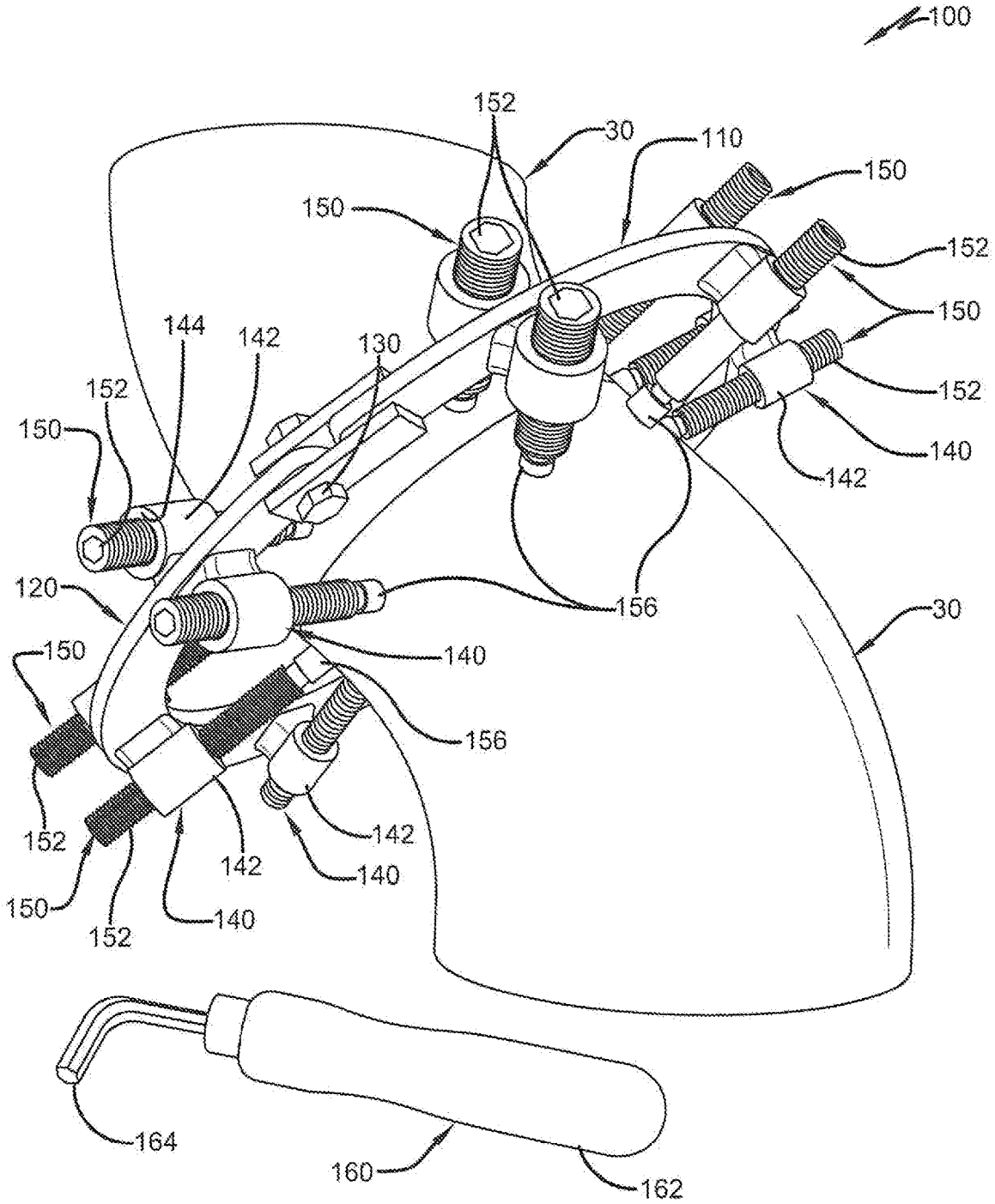
FIG. 4 illustrates a perspective view of the pipe alignment clamp of FIG. 2 closed around the junction of two irregularly shaped pipe segments and in accordance with the disclosed architecture.

Fasteners 130 may be any type of fastener known in the art, such as a threaded bolt and accompanying nut, a cotter pin, etc. Further, when only one end of first frame member 110 is joined with only one end of second frame member 120, as best shown in FIG. 5, the fastener 130 also serves as a hinge or pivot point, thereby enabling pipe alignment clamp 100 to be opened up to be positioned around a pipe segment and/or fitting 30, as best shown in FIGS. 3 and 4. Once positioned about pipe segments/fittings 30, a second fastener 130 may be positioned through the openings 116, 126 on the opposite ends of first and second frame members 110, 120 (i.e., opposite of the hinge or pivot point described above) to lock the pipe alignment clamp 100 in a continuous loop that encircles the pipe segments/fitting 30, as also best shown in FIGS. 3 and 4.

As best shown in FIGS. 2 through 5, the plurality of support members 140 are preferably positioned in spaced apart fashion along each of first frame member 110 and second frame member 120. More specifically, each of support members 140 are preferably permanently affixed to first frame member 110 and second frame member 120 by any means commonly known in the art, such as welding, etc. However, it is also contemplated that support members 140 may be integrally formed with first frame member 110 and second frame member 120, or even repositionable along either or both of first frame member 110 and second frame member 120 through the use of, for example, repositionable clamps (not shown).

Each of support members 140 is preferably comprised of a durable metal, such as steel or iron, a hardened plastic, or other suitable material, and further comprises a pair of support arms 142 that extend outwardly from each side of first frame member 110 or second frame member 120 in a substantially perpendicular manner, as best shown in FIGS. 3 through 5. Further, each of support arms 142 further comprise a continuous threaded opening 144 therein for receipt of an alignment screw 150, and the distance between the centerline of said threaded opening 144 and the nearest respective inboard or outboard surface 117, 118 of first frame member 110 or inboard or outboard surface 127, 128 of second frame member 120 is preferably less than one inch, and more preferably approximately ½ inch, to reduce the overall length of pipe segment or fitting 30 needed to properly operate pipe alignment clamp 100, as explained more fully below.

Each of alignment screws 150 is preferably comprised of a durable metal, such as steel or iron, a hardened plastic, or other suitable material, and further comprises a screw head 152, a threaded screw body 154 and a screw tip 156, as best shown in FIG. 5. Screw head 152 can be any type of screw head commonly known in the art and that includes a means for being driven into a corresponding threaded opening, such as threaded opening 144 in support arm 142. For example, screw head 152 can be in the form of a nut (e.g., a wing nut) that can be manipulated by hand, or could be capable of receiving an external driver, such as alignment screw tool 160. Threaded screw body 154 extends from screw head 152 to screw tip 156 and has a thread pitch and count that corresponds to that of threaded opening 144 in support arm 142.

As best shown in FIGS. 3 and 4, alignment screws 150 and threaded openings 144 are positioned such that, as alignment screw 150 is rotated clockwise within threaded opening 144, screw tip 156 moves almost perpendicular towards the exterior surface of pipe segment/fitting 30, eventually coming to contact therewith. Likewise, as alignment screw 150 is rotated counterclockwise within threaded opening 144, screw tip 156 moves away from the exterior surface of pipe segment/fitting 30. Screw tip 156 may be integrally formed with, or fixed to, the end of threaded screw body 154 opposite of screw head 152, or may be pivotably attached (e.g., through a ball and socket type connection) to the end of threaded screw body 154, thereby enabling screw tip 156 to better conform to the exterior surface of pipe segment/fitting 30.

As previously mentioned, pipe alignment clamp 100 may be manipulated manually by hand, or it may be accompanied by alignment screw tool 160 as part of a pipe alignment kit. More specifically, alignment screw tool 160 is useful for rotating alignment screws 150 in and out of threaded openings 144, as explained more fully below. In a preferred embodiment, alignment screw tool is comprised of a handle portion 162 and a tool tip 164. Tool tip 164 can be presented in a variety of different embodiments such as a flat or Phillips head screwdriver, 1-end wrench, etc., provided that it corresponds to the composition of screw head 152.

Having described one exemplary embodiment of the pipe alignment clamp 100 of the present invention, its use will now be generally described. As best illustrated in FIGS. 3 and 4, a user (not shown) desiring to properly align and join two sections of pipe segment/fitting 30 would start with pipe alignment clamp 100 on an open or unlocked position (as best shown in FIG. 5) and place clamp 100 directly over a junction of two adjacent pipes 30 that are in series. Once clamp 100 is properly positioned over the junction, fastener 130 can be inserted through openings 116, 126 in one end of first and second frame members 110, 120 to secure pipe alignment clamp 100 in a generally circular and locked position around pipe segments/fittings 30. The user would then thread each of alignment screws 150 into threaded openings 144 and in the direction of pipes 30 until contact is made. Importantly, because each of the two alignment screws 150 positioned in support arms 142 of a particular support member 140 are independently repositionable with respect to one another, pipe alignment clamp 100 can be used to align and secure two pipe segments 30 having different shapes or dimensions (e.g., a pipe segment to a slightly larger pipe fitting), unlike the pipe clamps 10 of the prior art.

Once the pipe alignment clamp 100 is properly secured to both segments of pipe 30, the same may be joined by a manufacturing process, such as threading, brazing, cementing, welding, or the like. After successful alignment and joining of the two pipe segments 30, the pipe alignment clamp 100 can be removed therefrom by rotating each of the alignment screws 150 out of threaded openings 144 in a direction opposite of pipes 30, and removing one of fasteners 130 to allow the first frame member 110 and second frame member 120 to pivot about the remaining fastener 130.

Notwithstanding the forgoing, the improved pipe alignment clamp device 100 can by any suitable size, shape, and configuration as is known in the art without affecting the overall concept of the invention, provided that it accomplishes the above stated objectives. One of ordinary skill in the art will appreciate that the shape and size of the device 100 and its various components, as show in the FIGS. are for illustrative purposes only, and that many other shapes and sizes of the device 100 are well within the scope of the present disclosure. Although dimensions of the device 100 and its components (i.e., length, width, and height) are important design parameters for good performance, the device 100 and its various components may be any shape or size that ensures optimal performance during use and/or that suits user need and/or preference.

Further, the inherent design and composition of the pipe alignment clamp 100, and specifically the dual placement and independent movement of the alignment screws 150 on either side of first and second frame members 110, 120, ensures not only that significantly smaller lengths of pipe segment/fitting is required for successful usage, but also permits the clamp 100 to be used to join two pipe segments/fittings 30 of different shape or dimensions. Finally, the relatively compact design of pipe alignment clamp 100, coupled with the absence of large protruding members, permit pipe alignment clamp 100 to be utilized in relatively confined spaces.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A pipe alignment clamp comprising:

a first semicircular frame member comprising a flat male plate first end comprising an opening, and pair of spaced apart female plates second end opposite the first end each comprising a continuous opening formed therein;

a second semicircular frame member attachable to the first frame member, the second semicircular frame member comprising a flat male plate first end comprising an opening, and pair of spaced apart female plates second end opposite the first end each comprising a continuous opening formed therein;

a first fastener for hingedly securing the flat male plate first end of the first semicircular frame member to the pair of spaced apart female plates second end of the second semicircular frame member via the opening and the continuous opening;

a second fastener for securing the flat male plate first end of the second semicircular frame member to the pair of spaced apart female plates second end of the first semicircular frame member via the opening and the continuous opening; and a plurality of support members positioned along each of the first and second frame members, each support member comprising a pair of support arms parallelly aligned to each other on opposite sides of the respective frame member; and a plurality of alignment screws positional within each of the support arms.

2. The pipe alignment clamp of claim 1, wherein the plurality of alignment screws comprise a first alignment screw independently repositionable relative to a second alignment screw for each pair of support arms.

3. The pipe alignment clamp of claim 1, wherein each support arm further comprises a continuous threaded opening therein for receipt of one of said alignment screws.

4. The pipe alignment clamp of claim 1, wherein each pair of support arms extend outwardly from the first and second frame members in a substantially perpendicular manner.

5. The pipe alignment clamp of claim 3, wherein the continuous threaded opening has a longitudinal centerline axis, and further wherein the distance between the longitudinal centerline axis and the first frame member is no more than one inch.

6. A pipe alignment kit comprising:

a pipe alignment clamp comprising;

a first semicircular frame member comprising a flat male plate first end comprising an opening, and pair of spaced apart female plates second end opposite the first end each comprising a continuous opening formed therein;

a second semicircular frame member attachable to the first frame member, the second semicircular frame member comprising a flat male plate first end comprising an opening, and pair of spaced apart female plates second end opposite the first end each comprising a continuous opening formed therein;

a first fastener for hingedly securing the flat male plate first end of the first semicircular frame member to the pair of spaced apart female plates second end of the second semicircular frame member via the opening and the continuous opening;

a second fastener for securing the flat male plate first end of the second semicircular frame member to the pair of spaced apart female plates second end of the first semicircular frame member via the opening and the continuous opening; and a plurality of support members positioned along each of the first and second frame members, each support member comprising a pair of support arms parallelly aligned to each other on opposite sides of the respective frame member; and a plurality of alignment screws positional within each of the support arms; and an alignment screw tool comprising a handle and a tool tip for independently adjusting each of the plurality of alignment screws within each of the support arms.

7. The pipe alignment kit of claim 6, wherein each of the support arms comprise a continuous threaded opening therein.

* * * * *